US009518766B2

(12) United States Patent
Flora et al.

(10) Patent No.: US 9,518,766 B2
(45) Date of Patent: Dec. 13, 2016

(54) METHOD AND SYSTEM FOR THERMOELECTRIC COOLING OF PRODUCTS ON DISPLAY AT RETAIL

(71) Applicant: Altria Client Services Inc., Richmond, VA (US)

(72) Inventors: Jason Flora, Richmond, VA (US); Dongmei Xu, Glen Allen, VA (US); Yahya Kargalioglu, Glen Allen, VA (US); Weiling Li, Moseley, VA (US)

(73) Assignee: Altria Client Services LLC, Richmond, VA (US)

( * ) Notice: Subject to any disclaimer, the term of this patent is extended or adjusted under 35 U.S.C. 154(b) by 309 days.

(21) Appl. No.: 14/202,939

(22) Filed: Mar. 10, 2014

(65) Prior Publication Data

US 2014/0260329 A1 Sep. 18, 2014

Related U.S. Application Data

(60) Provisional application No. 61/800,320, filed on Mar. 15, 2013.

(51) Int. Cl.
*F25B 21/02* (2006.01)
*A24F 23/04* (2006.01)

(52) U.S. Cl.
CPC ..... *F25B 21/02* (2013.01); *A24F 23/04* (2013.01)

(58) Field of Classification Search
CPC ..... F25B 21/02; F25B 21/04; H01L 35/30; H01L 35/00
USPC ..... 62/3.2, 3.3, 3.7, 2.6
See application file for complete search history.

(56) References Cited

U.S. PATENT DOCUMENTS

| | | | | |
|---|---|---|---|---|
| 3,097,027 | A * | 7/1963 | Mims | F16C 37/00 165/80.2 |
| 3,879,229 | A * | 4/1975 | Gilbert | H01L 35/34 136/202 |
| 4,627,242 | A | 12/1986 | Beitner | |
| 4,671,070 | A | 6/1987 | Rudick | |
| 4,738,114 | A | 4/1988 | Mullen | |
| 4,891,949 | A | 1/1990 | Caldarola | |
| 5,029,446 | A | 7/1991 | Suzuki | |
| 5,941,077 | A | 8/1999 | Safyan | |
| 6,141,975 | A | 11/2000 | Tatsumi | |
| 6,463,743 | B1 | 10/2002 | Laliberte | |
| 6,530,232 | B1 * | 3/2003 | Kitchens | F25D 31/007 62/3.2 |

(Continued)

FOREIGN PATENT DOCUMENTS

JP 2005197385 A 7/2005

*Primary Examiner* — Melvin Jones
(74) *Attorney, Agent, or Firm* — Buchanan Ingersoll & Rooney PC

(57) ABSTRACT

A thermoelectrically cooled system and method is disclosed, which includes a thermoelectrically cooled sleeve, which is configured to hold one or more cylindrical cans of a retail product. The thermoelectrically cooled sleeve includes an outer cylindrical body, an inner cylindrical body, a thermoelectric element located between the outer cylindrical body and the inner cylindrical body, and at least one pair of electrical leads attachable to the thermoelectrically cooled sleeve, and upon application of a source of electrical power to the pair of electrical leads heat moves through the thermoelectric element from the inner cylindrical body to the outer cylindrical body of the thermoelectrically cooled sleeve.

21 Claims, 6 Drawing Sheets

(56) References Cited

U.S. PATENT DOCUMENTS

| | | | | |
|---|---|---|---|---|
| 6,729,146 | B2 | 5/2004 | Lucatello | |
| 6,735,958 | B2 | 5/2004 | Baumann | |
| 6,894,215 | B2 * | 5/2005 | Akiba | H01L 35/30 136/204 |
| 7,451,603 | B2 | 11/2008 | Tuszkiewicz et al. | |
| 7,467,520 | B2 | 12/2008 | Van Loon et al. | |
| 7,650,757 | B2 * | 1/2010 | Bhatti | F25B 21/02 165/80.4 |
| 7,665,311 | B2 | 2/2010 | Steffensen et al. | |
| 2003/0140957 | A1 | 7/2003 | Akiba | |
| 2005/0109040 | A1 | 5/2005 | Hansen | |
| 2006/0277924 | A1 | 12/2006 | Platkin | |
| 2008/0148753 | A1 | 6/2008 | Welker et al. | |
| 2008/0163628 | A1 | 7/2008 | Lilke | |
| 2008/0209912 | A1 | 9/2008 | Upadhye et al. | |
| 2009/0179042 | A1 | 7/2009 | Milan et al. | |
| 2009/0249795 | A1 | 10/2009 | Chen | |
| 2010/0000230 | A1 | 1/2010 | Alahyari et al. | |
| 2011/0225981 | A1 | 9/2011 | Glaros et al. | |

* cited by examiner

METHOD AND SYSTEM FOR THERMOELECTRIC COOLING OF PRODUCTS ON DISPLAY AT RETAIL

RELATED APPLICATION(S)

The present application claims priority under 35 U.S.C. §119 to U.S. Provisional Patent Application No. 61/800,320, filed on Mar. 15, 2013, the entire content of which is hereby incorporated by reference.

FIELD

The present invention relates generally to a method and system for thermoelectric cooling of products on display at retail, and more particularly to a method and system for thermoelectric cooling of smokeless tobacco products on display at retail by use of a thermoelectric cooling rack and cylindrical member or sleeve.

WORKING ENVIRONMENT

Extended retail shelf life has historically been a challenge for some retail products such as moist smokeless tobacco (MST). Analytical chemistry data and tests have shown that select products stored at low temperatures (for example, approximately 4° C. to approximately 15° C., or approximately 40° F. to approximately 60° F.) can preserve desired flavors and significantly slow the formation of undesirable flavors during retail shelf life. In addition, some retailers store select moist smokeless tobacco (MST) products in small refrigerators for their customers. However, purchasing refrigerators for all retailers who sell moist smokeless tobacco products can be costly and consume precious space at retail (e.g. behind the counter). Refrigerators also make it difficult to display the products at retail, have maintenance issues, and can be large and noisy.

Accordingly, it would be desirable to have a system and method for thermoelectric cooling (for example, a Peltier cooler) of retail products such as smokeless tobacco products that are small and low cost for low temperature storage of products at retail.

SUMMARY

In accordance with an exemplary embodiment, a thermoelectrically cooled system is disclosed, the system comprising: a thermoelectrically cooled sleeve, which is configured to hold one or more cylindrical cans of a retail product, the thermoelectrically cooled sleeve comprised of an outer cylindrical body, an inner cylindrical body, a thermoelectric element located between the outer cylindrical body and the inner cylindrical body, and at least one pair of electrical leads attachable to the thermoelectrically cooled sleeve, and upon application of a source of electrical power to the at least one pair of electrical leads heat moves through the thermoelectric element from the inner cylindrical body to the outer cylindrical body of the thermoelectrically cooled sleeve.

In accordance with an exemplary embodiment, a thermoelectrically cooled system is disclosed, the system comprising: an upper member and a lower member, each of the upper and the lower members having an outer member and an inner member; a thermoelectric element located between the outer member and the inner member of at least one of the upper and lower members; an electrical source having at least one pair of electrical leads attachable to the at least one of the upper and lower members, and upon application of electrical power to the at least one pair of electrical leads heat moves through the thermoelectric element of at least one of the upper and lower members from the inner member to the outer member, such that the inner member is cooled and the outer member is simultaneously heated; and a plurality of parallel rods, which form one or more racks, and wherein the one or more racks are located between the upper member and the lower member.

In accordance with an exemplary embodiment, a thermoelectrically cooled system is disclosed, the system comprising: a plurality of thermoelectrically cooled rods, the plurality of thermoelectrically cooled rods forming at least one rack configured to hold one or more cylindrical cans of a retail product, and wherein the thermoelectrically cooled rods having an outer member, an inner member, a thermoelectric element located between the outer member and the inner member, and at least one pair of electrical leads, which are attachable to the thermoelectrically cooled rods; and upon application of a source of electrical power to the pair of electrical leads heat moves through the thermoelectric element from the outer member to the inner member of each of the thermoelectrically cooled rods such that the outer member is cooled and the inner member is simultaneously heated.

In accordance with an exemplary embodiment, a method of cooling a retail product is disclosed, the method comprising: generating a heat flux between a first type of material and a second type of material to create a cold surface and a hot surface; and placing one or more cans of a moist smokeless tobacco product having a metal lid in communication with the cold surface to extend shelf life of the product.

BRIEF DESCRIPTION OF THE DRAWING FIGURES

The foregoing features, in addition to others, will become more apparent from the detected description below considered in conjunction with the drawing figures in which like elements bear like reference numerals and wherein.

DETAILED DESCRIPTION OF THE PREFERRED EMBODIMENT

In accordance with an exemplary embodiment, it would be desirable to have a system and method for thermoelectric cooling of smokeless tobacco products that are small and low cost for low temperature storage of products at retail. In accordance with an exemplary embodiment, a method and system of cooling a retail product includes generating a heat flux between a first type of material and a second type of material to create a cold surface and a hot surface; and placing one or more cans of a moist smokeless tobacco product having a metal lid in communication with the cold surface to extend shelf life of the product.

In accordance with an exemplary embodiment, the system and methods described herein use thermoelectric cooling or the Peltier effect to extend shelf life of retail products, such as cans of moist smokeless tobacco (MST). The Peltier effect can use electric energy to transfer heat from one side of the device to the other, which creates a heat flux between two different types of materials creating a gradient from hot to cold. The two different types of materials form a thermoelectric element, which can be positioned or located between one side of the device and the other side of the device. One advantage of thermoelectric cooling and/or the Peltier effect is that the system and/or device do not have any moving parts and therefore, the system and/or device can be essentially maintenance free and can be small in size. In addition, the shape of the system and/or device can be flexible.

Figure 1:
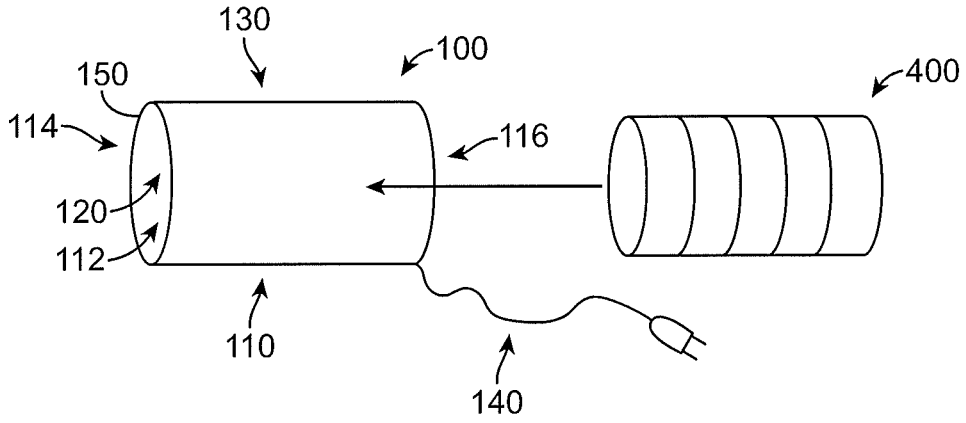
FIG. 1 is a perspective view of a thermoelectrically cooled sleeve and a plurality of cylindrical cans in accordance with an exemplary embodiment.

FIG. 1 is a perspective view of a thermoelectrically cooled sleeve 100 and a plurality of cylindrical cans 400 in accordance with an exemplary embodiment. As shown in FIG. 1, the thermoelectrically cooled sleeve 100 is preferably an elongated housing or member 110 having an elongated bore 112 therein with a first end 114 and second end 116. The elongated housing or member 110 has an inner cylindrical body 120 and an outer cylindrical body 130, which together form a cylindrical walled housing. In accordance with an embodiment, the elongated housing or member 110 is a thin walled cylindrical housing having a thickness of less than 1 inch, and more preferably less than 0.5 inches. A thermoelectric element (or module) 150 can be located between the inner cylindrical body 120 and the outer cylindrical body 130. An electrical source 140 having at least one pair of electrical leads 142, 144 (FIG. 3) is preferably connected and/or attachable to the inner or outer cylindrical bodies 120, 130 of the thermoelectrically cooled sleeve 100, which creates a heat flux upon application of electrical power to the leads 142, 144. In accordance with an exemplary embodiment, upon application of a source of electrical power to the at least one pair of electrical leads 142, 144 heat moves from the inner cylindrical body 120 to the outer cylindrical body 130 of the thermoelectrically cooled housing 110 via the thermoelectric elements 150.

Figure 2:
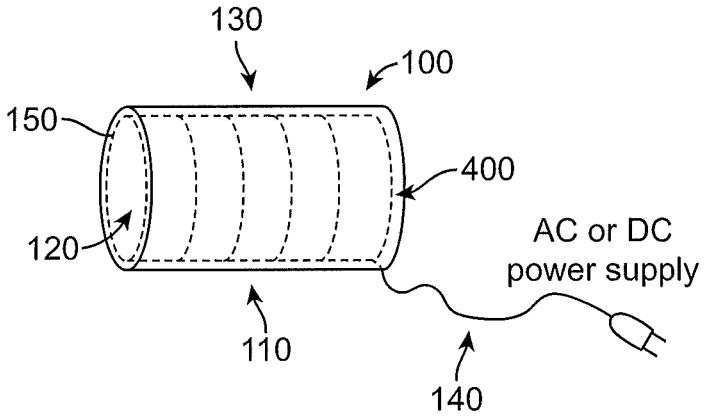
FIG. 2 is a perspective view of the thermoelectrically cooled sleeve and the plurality of cylindrical cans in accordance with an exemplary embodiment.
Figure 9:
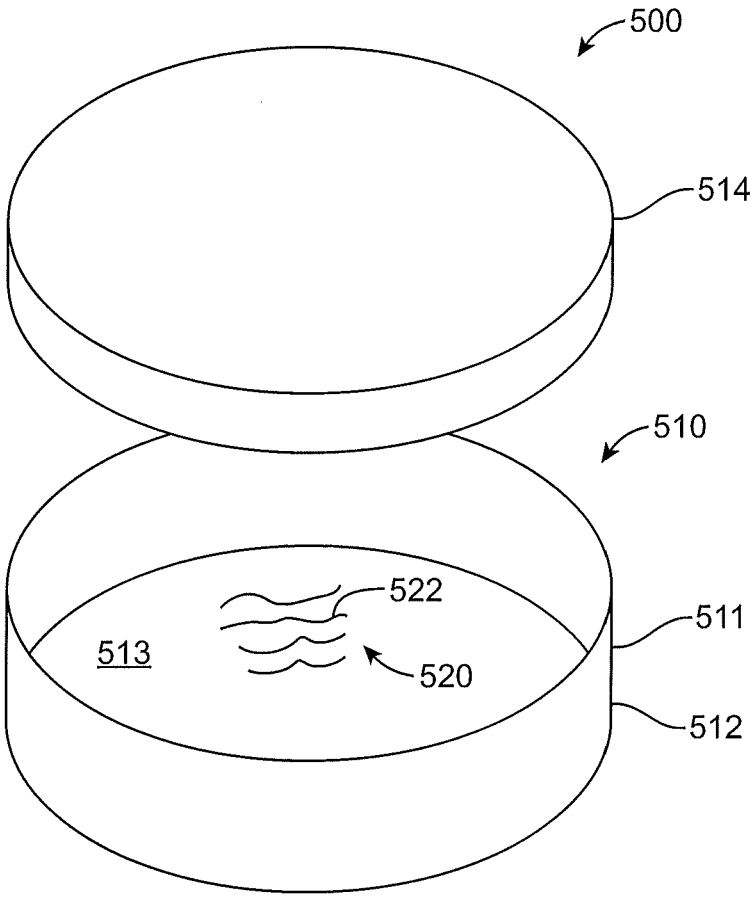
FIG. 9 is a perspective view of a retail product in the form of cylindrical can of a smokeless tobacco product having a metal lid.

As shown in FIG. 2, in accordance with an exemplary embodiment, the thermoelectrically cooled sleeve 100 is configured to hold a sleeve (or plurality of cans or canisters) 400 of one or more retail or consumer products 500 (FIG. 9). In accordance with an exemplary embodiment, the sleeve 400 of the retail or consumer product 500 can be a plurality of cans of a smokeless tobacco and/or moist smokeless tobacco product. For example, the thermoelectric sleeve 100 is preferably configured to hold 5 to 10 cans of a moist smokeless tobacco (MST) product. In accordance with an exemplary embodiment, the moist smokeless tobacco products can be sold in logs of five (5) cans 510 and/or ten (10) cans 510.

Figure 3:
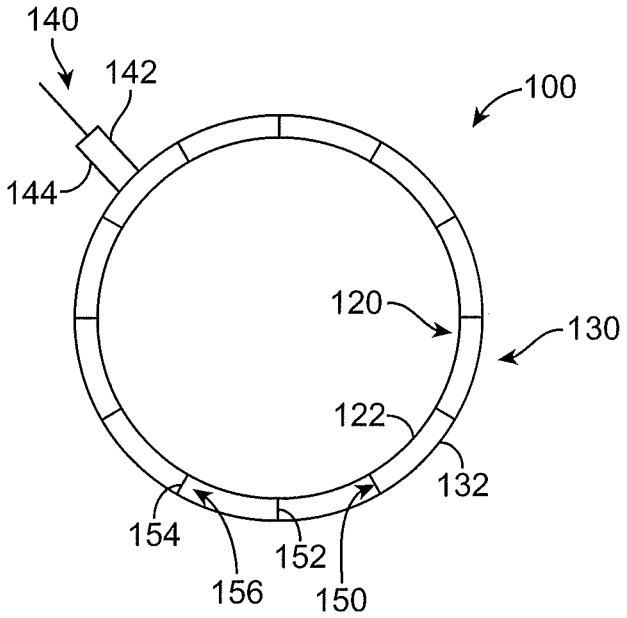
FIG. 3 is a cross-sectional view of an end of a thermoelectrically cooled sleeve in accordance with an exemplary embodiment.

FIG. 3 is a cross-sectional view of a thermoelectrically cooled sleeve 100 having an inner cylindrical body 120 and an outer cylindrical body 130, which are formed from a first member 122 and a second member 132, respectively. In accordance with an exemplary embodiment, upon application of a source of electrical current 140 to the at least one pair of electrical leads 142, 144, a heat flux 156 is generated between the two different materials 152, 154, which form the thermoelectric element 150. The two different materials 152, 154 can be positioned between the first and second members 122, 132, which form the thermoelectrically cooled sleeve 100. The thermoelectrically cooled sleeve 100 can use the Peltier effect to create a heat flux 156 between the two different types of materials 152, 154. The Peltier effect transfers heat from one side of a device (e.g., inner cylindrical body 120) to the other side (e.g., outer cylindrical body 130) against the temperature gradient (from cold to hot), with consumption of electrical energy. Thus, the inner cylindrical body 120 can be cooled and the outer cylindrical body 130 can be simultaneously heated. Different types of metallic materials, or alternating p-type and n-type semiconductor elements connected by metallic connectors preferably create the two different types of materials 150, 152. Upon application of a source of electrical power, the electrical charge flows through the n-type element, crosses a metallic interconnect, and passes into the p-type element. The electrons in the n-type element move opposite the direction of current and holes in the p-type element will move in the direction of current, both removing heat from one side of the device.

The source of electrical power 140 can be either a direct current (DC) source, or alternatively, an alternating current (AC) source. For example, the source of electrical power 140 can be a 12V DC, 6 A current. In accordance with an exemplary embodiment, the inner cylindrical body 120 of the thermoelectrically cooled sleeve 100 is preferably cooled to between approximately 40° F. (or 4.4° C.) to approximately 60° F. (or 15.6° C.).

Figure 4:
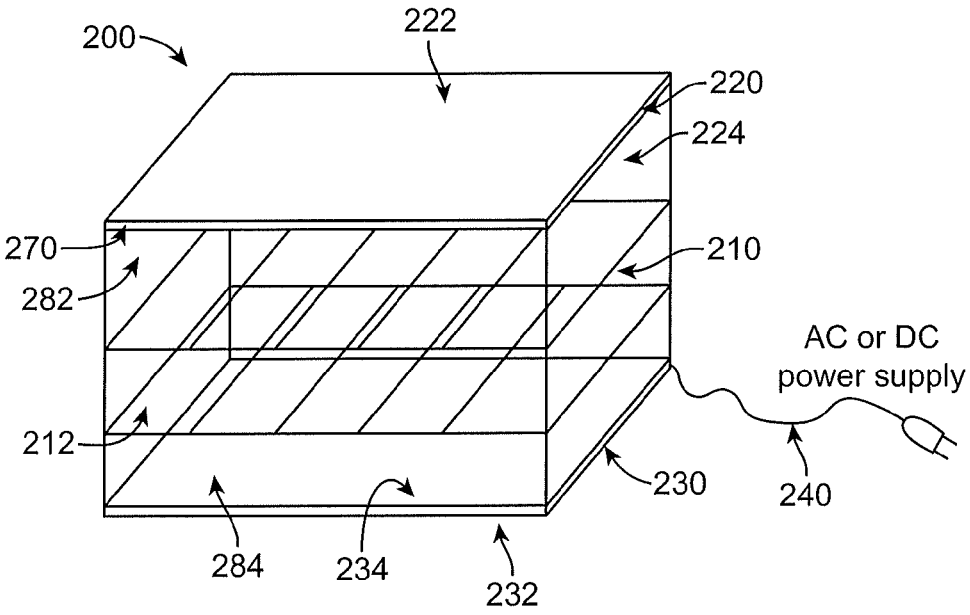
FIG. 4 is a perspective view of a thermoelectrically cooled rack in accordance with an exemplary embodiment.

FIG. 4 is a perspective view of a thermoelectrically cooled rack 200 in accordance with another exemplary embodiment. As shown in FIG. 4, the thermoelectrically cooled rack 200 can include a plurality of rods 210, an upper or top member 220, and/or a lower or bottom member 230. A thermoelectric element (or module) 270 can be located between an outer member 222, 232 and an inner member 224, 234 of at least one of the upper and lower members 220, 230. An electrical source 240 having at least one pair of electrical leads 242, 244 (FIG. 6) is preferably connected and/or attachable to at least one of the upper and/or lower members 220, 230. Upon application of electrical power to the at least one pair of electrical leads 242, 244, heat moves through the at least one of the upper and/or lower members 220, 230 from the inner member 224, 234 to the outer member 222, 232. In accordance with an embodiment, the plurality of rods 210 are in thermal contact or communication with at least one of the upper and lower member 220, 230 for improved cooling. In accordance with an exemplary embodiment, heat moves from the inner member 224, 234 to the outer member 222, 232 of both the upper and lower members 220, 230, which can provide cooling between the upper and lower members 220, 230.

The rack 200 also preferably includes a plurality of parallel rods 210, which form one or more racks 212. The one or more racks 212 are configured to receive a side portion or surface of one or more cylindrical cans 510 (FIG. 9) of a retail product 520. Each of the inner members 224, 234 preferably include an inner surface (i.e., exposed inner surface) 282, 284, which is exposed to the thermoelectrically cooled portion of the rack 200, which holds or houses the retail product 520. In accordance with an exemplary embodiment, the retail product 520 is a smokeless tobacco and/or moist smokeless tobacco product 522.

Figure 5:
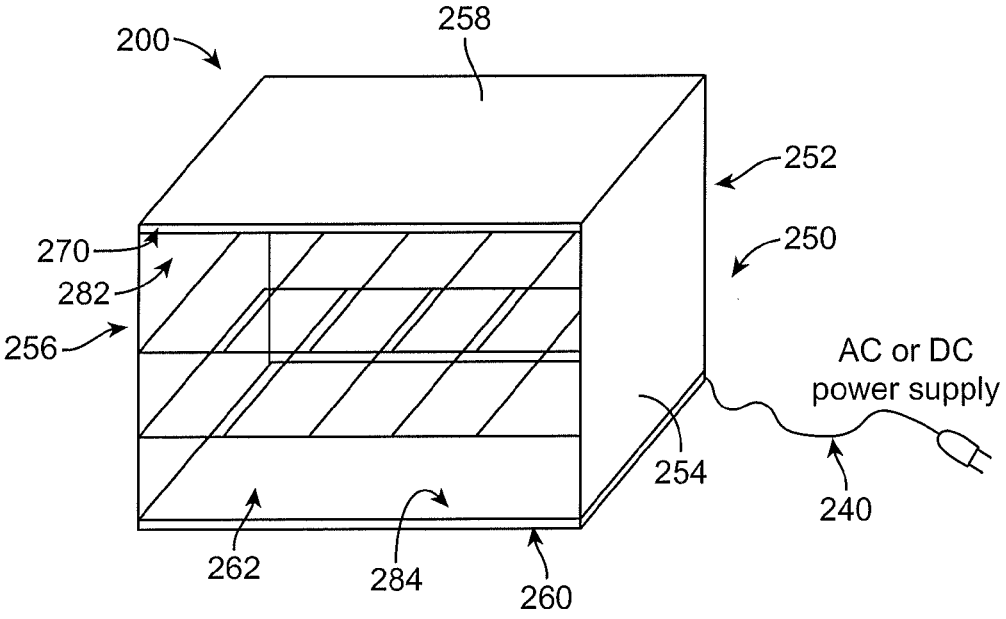
FIG. 5 is a perspective view a thermoelectrically cooled rack within a housing in accordance with an exemplary embodiment.

In accordance with an exemplary embodiment, as shown in FIG. 5, the rack 200 also preferably includes a housing 250, which houses the thermoelectrically cooled system. The housing 250 can include a rear wall 252, a pair of sidewalls 254, 256, a top wall 258, a bottom wall 260, and a door 262. Alternatively, each of the walls 252, 254, 256, 258, 260 and the door 262 are optional and any combination thereof can be used. For example, the rack 200 can include only the top and bottom members 220, 230 and the plurality of parallel rods forming the one or more racks 212. The door 262 is preferably a transparent door, which allows the retail product 520 to be visible through the transparent door 262, and includes a means for opening and closing thereof. In addition, the housing 250 including one or more of the walls 252, 254, 256, 258, 260 and the door 262 can display company trademarks and logos, product information, and/or marketing information associated with the retail product contained therein.

Figure 6:
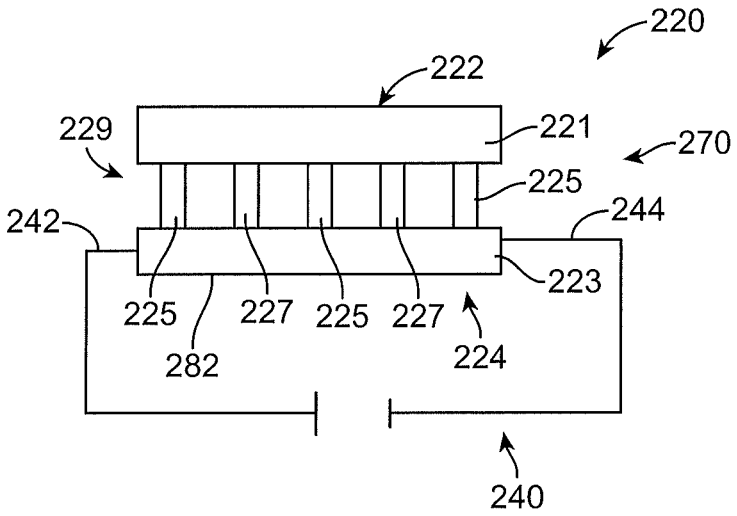
FIG. 6 is a cross-sectional view of an upper or top member and/or a bottom or lower member having thermoelectrically cooled elements therein in accordance with an exemplary embodiment.

FIG. 6 is a cross-sectional view of a portion of a thermoelectrically cooled member in the form of the upper or top member 220. As shown in FIG. 6, the upper or top member 220 has an outer member 222 and an inner member 224, which is formed from a first member 221, and a second member 223, respectively. Upon application of a source of electrical current to the at least one pair of electrical leads 242, 244, which is attached to the first member 221, a heat flux 229 is generated between two different materials 225, 227, which form the thermoelectric element 270. The two different materials 225, 227 can be positioned between the first and second members 221, 223. The upper member 220 can use the Peltier effect to create a heat flux 229 between the two different types of materials 225, 227. The Peltier effect transfers heat from one side of a device (e.g., inner member 224) to the other side (e.g., outer member 222) against the temperature gradient (from cold to hot), with consumption of electrical energy. Thus, the inner member 224 can be cooled and the outer member 222 can be simultaneously heated. In accordance with an exemplary embodiment, the inner member 224 of the upper or top member 220 and the inner member 234 of the lower or bottom member 230 is preferably cooled to between approximately 40° F. (or 4.4° C.) to approximately 60° F. (or 15.6° C.). Different types of metallic materials or alternating p-type and n-type semiconductor elements connected by metallic connectors preferably create the two different types of materials 225, 227.

Figure 7:
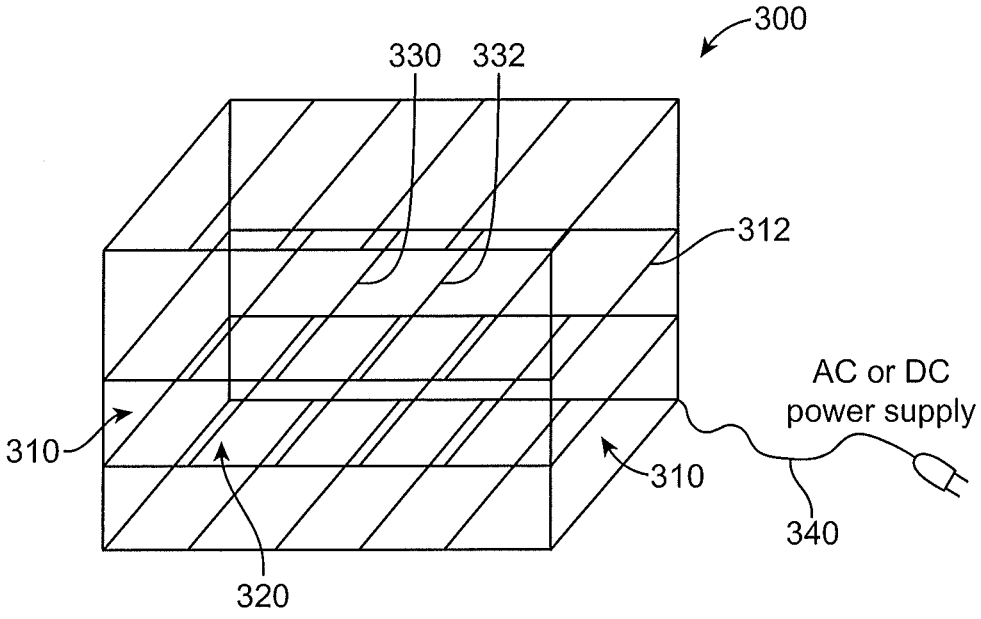
FIG. 7 is a perspective view of a thermoelectrically cooled rack in accordance with an exemplary embodiment.
Figure 8:
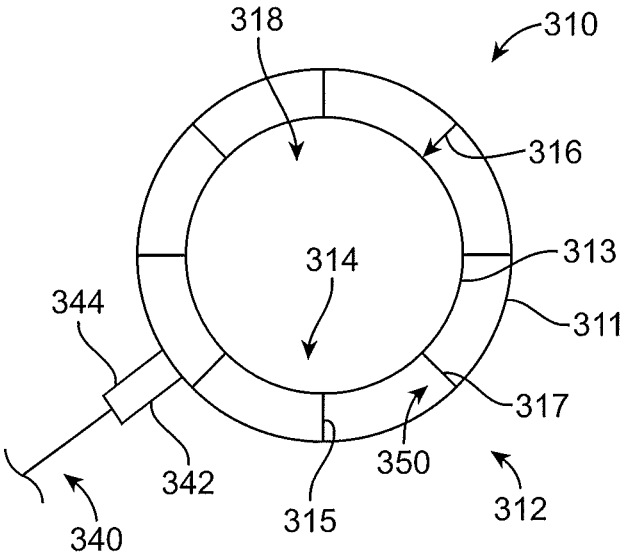
FIG. 8 is a cross-sectional view of an end of a thermoelectrically cooled rod in accordance with an exemplary embodiment.

FIG. 7 is a perspective view of a thermoelectrically cooled rack 300 in accordance with another exemplary embodiment. As shown in FIG. 7, the thermoelectrically cooled rack 300 can include a plurality of thermoelectrically cooled rods 310, each of the thermoelectrically cooled rods 310 having an outer member 312 and an inner member 314 (FIG. 8). A thermoelectric element (or module) 350 can be located between the outer member 312 and the inner member 314 of each of the thermoelectrically cooled rods 310. An electrical source 340 having at least one pair of electrical leads 342, 344 (FIG. 8) is preferably connected and/or attachable to one or more of the thermoelectrically cooled rods 310. Upon application of electrical power to the at least one pair of electrical leads 342, 344, heat moves through the thermoelectrically cooled rods 300 from the outer member 312 to the inner member 314 creating a heat flux.

In accordance with an exemplary embodiment, the plurality of thermoelectrically cooled rods 310 preferably form at least one rack 320, which is configured to hold one or more retail products 500 (FIG. 9). The at least one rack 320 preferably includes one or more pairs of parallel thermoelectrically cooled rods 330, 332, which are configured to receive a portion of one or more cylindrical cans 510 of a retail product 520. In accordance with an exemplary embodiment, the retail product 520 is a smokeless tobacco and/or moist smokeless tobacco product 522.

FIG. 8 is a cross-sectional view of a thermoelectrically cooled rod 310 having an outer member 312 and an inner member 314, which is formed from a first member 311 and a second member 313, respectively. The thermoelectrically cooled rods 310 can use the Peltier effect to create a heat flux 316 using two different types of materials 315, 317 positioned between the first and second members 311, 313. The two different types of materials 315, 317 form the thermoelectric element 350. In accordance with an exemplary embodiment, the heat flux 316 between the two different types of materials 315, 317, can be created by different types of metallic materials, or alternating p-type and n-type semiconductor elements connected by metallic connectors. The application of a source of electrical current to the at least one pair of electrical leads 342, 344, generates the heat flux 316 between the two different materials 315, 317.

As shown in FIG. 8, each of the plurality of cooled rods 310 includes an outer member 312 and an inner member 314. The Peltier effect transfers heat from one side of a device (e.g., outer member 312) to the other side (e.g., inner member 314) against the temperature gradient (from cold to hot), with consumption of electrical energy. Thus, the outer member 312 can be cooled and the inner member 314 can be simultaneously heated. In accordance with an exemplary embodiment, each of the cooled rods 310 can include a heat sink 318, which dissipates the heat from the inner member 314 into the surrounding air. The outer member 312 of the thermoelectrically cooled rods 310 are preferably cooled to between approximately 40° F. (4.4° C.) to approximately 60° F. (15.6° C.). In accordance with an exemplary embodiment, the source of electrical power 340 can be a direct current (DC) source, or alternatively, an alternating current (AC) source. In accordance with an exemplary embodiment, the source of electrical power is a 12V DC, 6 A current.

In accordance with an exemplary embodiment, the thermoelectrically cooled sleeves and racks 100, 200, 300 are preferably configured to fit on a counter or counter top of a retail market and/or retail shop to extend the shelf life of products contained therein. The sleeves and racks 100, 200, 300 can also include a system (not shown) for pushing the cylindrical cans 510 to a proximal portion or front portion of the thermoelectrically cooling system for ease of access by the consumer.

In accordance with an exemplary embodiment, as shown in FIG. 9, the one or more retail products 500 is at least one cylindrical can or canister 510 of a retail product 520 preferably in the form of a smokeless tobacco product 522. The smokeless tobacco product 522 is preferably a moist smokeless tobacco product, such as a chewing tobacco, dip and/or a snus type product (e.g. Copenhagen®). In accordance with an exemplary embodiment, the can or canister 510 is a wax coated cardboard or plastic can 512 with a metal lid 514. In accordance with an exemplary embodiment, the metal lid 514 provides the can 510 with enhanced conductivity, which in turn extends the shelf life of the product. Alternatively, the smokeless tobacco product can be packaged in an all-plastic can 510, which does not include any metal and/or cardboard materials.

In accordance with an exemplary embodiment, the cylindrical can 510 of the smokeless tobacco product 522 can include a cylindrical housing 511 having a base 513 thereto and a lid 514. The cylindrical housing 511 and the base 513 are preferably made from a paper-like product and the lid 514 is made from metal-like product. Alternatively, the cylindrical housing 511, the base 513 and the lid 514 can be made from a plastic or plastic like material. The cylindrical housing 511 is preferably approximately 2.0 to 3.0 inches in diameter and approximately 0.75 to 1.50 inches in height, and more preferably approximately 2.6 inches in diameter and approximately 1.0 inches in height.

The principles, preferred embodiments and modes of operation of the present invention have been described in the foregoing specification. However, the embodiment, which is intended to be protected, is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents, which fall within the spirit and scope of the present invention as defined in the claims be embraced thereby.

What is claimed is:

1. A thermoelectrically cooled system, the system consisting of:

a thermoelectrically cooled sleeve, which is configured to hold one or more cylindrical cans of a retail product, the thermoelectrically cooled sleeve comprised of an outer cylindrical body, an inner cylindrical body, a thermoelectric element located between the outer cylindrical body and the inner cylindrical body, and at least one pair of electrical leads attachable to the thermoelectrically cooled sleeve, and upon application of a source of electrical power to the at least one pair of electrical leads heat moves through the thermoelectric element from the inner cylindrical body to the outer cylindrical body of the thermoelectrically cooled sleeve.

2. The system of claim 1, wherein the thermoelectric element is comprised of two different types of materials positioned between the inner cylindrical body and the outer cylindrical body of the thermoelectrically cooled sleeve, and wherein a heat flux is created between the inner cylindrical body and the outer cylindrical body of the thermoelectrically cooled sleeve.

3. The system of claim 2, wherein the two different types of materials are different types of metallic materials, or alternating p-type and n-type semiconductor elements connected by metallic connectors.

4. The system of claim 1, at least one cylindrical can of a retail product, and wherein the at least one cylindrical can includes a cylindrical housing having a base and a metal lid.

5. The system of claim 4, wherein the at least one can of the retail product comprises a log of 5 to 10 cans of a moist smokeless tobacco product.

6. A thermoelectrically cooled system, the system comprising:

an upper member and a lower member, each of the upper and the lower members having an outer member and an inner member;

a thermoelectric element located between the outer member and the inner member of at least one of the upper and lower members;

an electrical source having at least one pair of electrical leads attachable to the at least one of the upper and lower members, and upon application of electrical power to the at least one pair of electrical leads heat moves through the thermoelectric element of at least one of the upper and lower members from the inner member to the outer member, such that the inner member is cooled and the outer member is simultaneously heated; and a plurality of parallel rods, which form one or more racks, and wherein the one or more racks are located between the upper member and the lower member.

7. The system of claim 6, wherein the thermoelectric element is two different types of material positioned between the inner and the outer members of the at least one of the upper and the lower members, and wherein a heat flux is created between the inner and outer members of the at least one of the upper and lower members.

8. The system of claim 7, wherein the two different types of materials are different types of metallic materials, or alternating p-type and n-type semiconductor elements connected by metallic connectors.

9. The system of claim 6, wherein the upper and the lower members are each attachable to at least one pair of electrical leads and upon application of electrical power to the electrical leads, heat moves from the inner member to the outer member of each of the upper and lower members.

10. The system of claim 9, comprising:

a housing, the housing having one or more of the following: a rear wall, one or more sidewalls, a top wall, a bottom wall, and a door.

11. The system of claim 9, comprising:

a housing, the housing having a rear wall, a pair of sidewalls, a top wall, a bottom wall, and a transparent door.

12. A thermoelectrically cooled system, the system comprising:

a plurality of thermoelectrically cooled rods, the plurality of thermoelectrically cooled rods forming at least one rack configured to hold one or more cylindrical cans of a retail product, and wherein the thermoelectrically cooled rods having an outer member, an inner member, a thermoelectric element located between the outer member and the inner member, and at least one pair of electrical leads, which are attachable to the thermoelectrically cooled rods; and upon application of a source of electrical power to the pair of electrical leads heat moves through the thermoelectric element from the outer member to the inner member of each of the thermoelectrically cooled rods such that the outer member is cooled and the inner member is simultaneously heated.

13. The system of claim 12, wherein the thermoelectric element is two different types of material positioned between the inner and the outer members of the thermoelectrically cooled rods; and wherein a heat flux is created between the inner member and the outer member of the thermoelectrically cooled rods.

14. The system of claim 13, wherein the two different types of materials are different types of metallic materials, or alternating p-type and n-type semiconductor elements connected by metallic connectors.

15. The system of claim 12, wherein the at least one rack comprises a pair of parallel thermoelectrically cooled rods, which are configured to receive a side portion of the one or more cylindrical cans of the retail product.

16. The system of claim 15, wherein the retail product is a moist smokeless tobacco product, and each of the one or more cylindrical cans of the moist smokeless tobacco product includes a cylindrical housing having a base and a metal lid.

17. The system of claim 12, comprising:

a heat sink, which is adjacent to the inner member of the thermoelectrically cooled rods.

18. The system of claim 12, comprising:

a source of electricity, which transfers heat from the outer member of the thermoelectrically cooled rod to the inner member of the thermoelectrically cooled rod.

19. A method of cooling a retail product, the method comprising:

generating a heat flux between a first type of material and a second type of material to create a cold surface and a hot surface; and placing one or more cans of a moist smokeless tobacco product having a metal lid in communication with the cold surface to extend shelf life of the retail product.

20. The method of claim 19, further comprising generating the heat flux using Peltier elements in the form of a plurality of semiconductor blocks, which are fixed between two ceramic plates.

21. The method of claim 19, wherein the Peltier elements are shaped as a cylindrical sleeve, which is configured to receive the one or more cylindrical cans of the moist smokeless tobacco product.

* * * * *